US011315376B2

(12) United States Patent
Lovelock et al.

(10) Patent No.: US 11,315,376 B2
(45) Date of Patent: Apr. 26, 2022

(54) CONTINUOUS AUTHORIZATION MONITORING

(71) Applicant: ASSA ABLOY AB, Stockholm (SE)

(72) Inventors: Julian Eric Lovelock, Pleasanton, CA (US); Georges Robert Vieux, Fremont, CA (US)

(73) Assignee: ASSA ABLOY AB, Stockholm (SE)

( * ) Notice: Subject to any disclaimer, the term of this patent is extended or adjusted under 35 U.S.C. 154(b) by 180 days.

(21) Appl. No.: 16/474,921

(22) PCT Filed: Dec. 27, 2017

(86) PCT No.: PCT/IB2017/001724
§ 371 (c)(1),
(2) Date: Jun. 28, 2019

(87) PCT Pub. No.: WO2018/127732
PCT Pub. Date: Jul. 12, 2018

(65) Prior Publication Data

US 2021/0134097 A1 May 6, 2021

Related U.S. Application Data

(60) Provisional application No. 62/443,990, filed on Jan. 9, 2017.

(51) Int. Cl.
*G07C 9/27* (2020.01)

(52) U.S. Cl.
CPC ..... *G07C 9/27* (2020.01)

(58) Field of Classification Search
CPC ..... G07C 9/27
See application file for complete search history.

(56) References Cited

U.S. PATENT DOCUMENTS

2006/0219778 A1* 10/2006 Komatsu ..... H04L 63/06 235/382
2007/0096868 A1* 5/2007 Bauchot ..... G07C 9/28 340/5.27

(Continued)

FOREIGN PATENT DOCUMENTS

FR 2946817 A1 12/2010
WO WO-2018127732 A2 7/2018

OTHER PUBLICATIONS

"International Application Serial No. PCT/IB2017/001724, International Search Report dated Jul. 17, 2018", 6 pgs.

(Continued)

*Primary Examiner* — Nabil H Syed
(74) *Attorney, Agent, or Firm* — Schwegman Lundberg & Woessner, P.A.

(57) ABSTRACT

A security system includes a first security badge having a visual portion that varies according to signals provided to the first security badge and an authorization server that periodically provides signals to the first security badge in response to a query of the authorization server by the first security badge while the first security badge remains in a controlled zone, the signals varying independently of reader access of the first security badge. The first security badge may be read by a reader only in connection with initial entry into the controlled zone. Authorization of a user of the first security badge may vary while the user remains in the controlled zone. The first security badge may include a visual image of a user of the first security badge and displays additional information. The additional information may include name and authorization status of the user.

20 Claims, 9 Drawing Sheets

(56) References Cited

U.S. PATENT DOCUMENTS

| | | | | |
|---|---|---|---|---|
| 2009/0174633 | A1 | 7/2009 | Kumhyr | |
| 2011/0102156 | A1 | 5/2011 | Gravelle et al. | |
| 2014/0043141 | A1* | 2/2014 | Cazanas | H04L 63/08 340/5.81 |
| 2014/0266590 | A1 | 9/2014 | Guillaud | |
| 2016/0379426 | A1* | 12/2016 | Tholen | G07C 9/21 340/5.21 |
| 2017/0229071 | A1* | 8/2017 | McMahan | G07C 9/253 |

OTHER PUBLICATIONS

"International Application Serial No. PCT/IB2017/001724, Invitation to Pay Additional Fees and Partial Search Report dated May 22, 2018", 12 pgs.
"International Application Serial No. PCT/IB2017/001724, Written Opinion dated Jul. 17, 2018", 10 pgs.
"European Application Serial No. 17842292.9, Response to Communication pursuant to Rules 161(1) and 162 EPC filed Feb. 26, 2020", 8 pgs.

* cited by examiner

CONTINUOUS AUTHORIZATION MONITORING

CROSS-REFERENCE TO RELATED APPLICATIONS

This application is a national stage application of International PCT patent application no. PCT/IB2017/001724, filed Dec. 27, 2017, titled "CONTINUOUS AUTHORIZATION MONITORING," which claims priority to U.S. provisional patent application No. 62/443,990 filed on Jan. 9, 2017, titled "CONTINUOUS AUTHORIZATION MONITORING," each of which is hereby incorporated herein by reference in its entirety.

TECHNICAL FIELD

This application is related to the field of security and more particularly to the field of monitoring and displaying access rights of a user having an identity badge.

BACKGROUND OF THE INVENTION

Users wear a badge to display that they are authorized to be present in a location. Additionally, users need to know that the persons in their presence have the authority to be there. A positive authorization may take the form of a display showing a photo of the individual authenticated, may consist of the display of a random synchronized image, may consist of a single image that indicates the user is authenticated, or may consist of a single (green) light added to a static display (i.e. traditional badge).

Recently, badges have begun to dynamically display that the wearer is authorized within a given zone (defined by the badge readers). Either the user's photo is displayed when authorized to be present, or a random (yet synchronized) image is displayed on the badge of all authorized personnel within a zone. The authorization is established at the time the user enters the zone. The badge image may change dynamically over time, however the user's authority is read only when entering or leaving the zone. In such a case, it may be desirable to indicate the user's change in authority while the user remains in the given zone.

Accordingly, it would be desirable to provide a system that addresses these issues.

SUMMARY OF THE INVENTION

According to the system described herein, a security system includes a first security badge having a visual portion that varies according to signals provided to the first security badge and an authorization server that periodically provides signals to the first security badge in response to a query of the authorization server by the first security badge while the first security badge remains in a controlled zone, the signals varying independently of reader access of the first security badge. The first security badge may be read by a reader only in connection with initial entry into the controlled zone. Authorization of a user of the first security badge may vary while the user remains in the controlled zone. The first security badge may include a visual image of a user of the first security badge and displays additional information. The additional information may include name and authorization status of the user. Authorization status of the user may be indicated by a watermark superimposed on the image of the user, a word or phrase dynamically provided on the first security badge, dimming the image of the user, dimming the first security badge, a strikethrough superimposed on the image of the user, an LED provided on the first security badge, and/or a background color of the first security badge. Authorization status of the user may be indicated by a sound provided by the first security badge. The first security badge may query the authorization server using a smartphone that is in communication with the first security badge and with the authorization server. A query message from the first security badge to the authorization server may include location information indicating a location of the first security badge. The authorization server may use the location information to determine authorization for the first security badge. The security system may also include a second security badge provided in the controlled zone. The first security badge may indicate authorization status of the second security badge. The second security badge may query the authorization server for authorization status of the second security badge. The second security badge may query the first security badge for authorization status of the second security badge.

According further to the system described herein, operating a security system includes providing a first security badge having a visual portion that varies according to signals provided to the first security badge, the first security badge periodically querying an authorization server while the first security badge remains in a controlled zone, and the authorization server providing the signals to the first security badge, the signals varying independently of reader access of the first security badge. The first security badge may be read by a reader only in connection with initial entry into the controlled zone. Authorization of a user of the first security badge may vary while the user remains in the controlled zone. The first security badge may include a visual image of a user of the first security badge and displays additional information. The additional information may include name and authorization status of the user. Authorization status of the user may be indicated by a watermark superimposed on the image of the user, a word or phrase dynamically provided on the first security badge, dimming the image of the user, dimming the first security badge, a strikethrough superimposed on the image of the user, an LED provided on the first security badge, and/or a background color of the first security badge.

According further to the system described herein, a non-transitory computer readable medium contains software that operates a security system. The software includes executable code that implements the method of one of claims 15-20.

The system described herein relates to concepts of continuous validation and display refresh showing a of a user's access authority. A user's access rights may be continuously monitored while the user is in a controlled zone. The zone may be defined by a reader, or by a beacon device that continuously facilitates the authentication or authorization process. Access rights are not merely determined at entry and exit to a defined zone. Instead, the user maintains a permanent connection to an authentication/authorization server or makes frequent contact with authorization servers so that access authority of the user is continuously or repeatedly updated and displayed.

The user may lose access or have the status of diminished authority for any of a number of reasons:

a. it has been discovered that an error was made in granting the original access, and access rights of the user have been revoked;
b. there has been a change in status and access rights of the user have been revoked;

c. the user requires a physical escort while present and the escort of the user is no longer physically present;

d. the user requires the presence of an associated device (such as a cell phone), and the device is no longer present. The associated cell phone may be used to provide additional authorization data about the user or the associated cell phone may provide functionality required to authenticate the user that is not available on the badge of the user. In some cases, communication with an associated device may have been severed;

e. the user requires an escort while accessing sensitive data and the escort is no longer physically present, i.e., access to highly sensitive data by the user (e.g., on a network) may be restricted to when an escort is physically close to the user. Note that this mechanism may be used to implement double signatures—instead of both users needing to log in to the same system, one badge holder releases directly to another badge holder the needed authority to access data. Alternative, each badge holder reports their geolocation and/or identifies their zone location to a remote server. The remote server uses the reported information to determine if proximity requirements have been meet and if authorization to a particular resource is appropriate. The two users could display their co-dependence in some visual way. For example an image size on badges of the two users may be different from all others (e.g., 20% larger). The re-authorization process may be continuous so that re-authorization is repeatedly re-validated at a high rate, and/or a lack of signal being transmitted is immediately recognized and validation authority of a user is immediately revoked.

f. the security level of the zone may have been elevated due to arrival of others in the zone. For example, existing users present in a zone may possess a first clearance level, and other badge wearers containing second, higher, clearance level have just entered the zone. The zone may be dynamically elevated to require users to have the second clearance level to remain.

Reduced or partial authority might be displayed in a number of ways, indicated by the following:

1. The badge might display a separate image to communicate authority level.
2. The badge might dim the image of a user with diminished authority.
3. A negative authorization may be indicated by absence of any image in a display of the badge.
4. A negative authorization may consist of an overt or subtle change in the display of information about the user. For example, if the user is wearing a valid badge, but is not authorized for a specific area, a photo of the user might be displayed with a water mark that is subtle but visible by all, or the visual change may be more pronounced such as a strike through (e.g., across an image of the user). Alternatively, a display containing an image of the user might be altered so that a background screen changes from white to gray. Alternative, some other subtle change such as an addition of some small graphic or icon to the display may be made to indicate authorization or lack of authorization. The subtle change may be recognizable by select individuals. Thus, the validity or invalidity of the badge may be muted and the environment may appear open and accepting while still afford significant authorization and alerting.

One or more (or all) of the badges in a zone may have a summary indication of the status of all individuals within a zone. Similarly, one or more (or all) of the badges in a zone may have an alert mechanism to warn badge wearers of a potential authorization problem. For example, if any an individual is not authorized, or has limited authority (such as a lower clearance level), the summary indication for all badges might be configured to light up an LED to provide a single blinking red led. The same LED may display a solid green light to show all known badge holders within a zone are deemed to be authorized. Alternatively, to alert users of potential issues, a badge might vibrate, similar to vibration provided by a cell phone when receiving a phone call in a vibrate mode. Alternatively, some or all of the badges may have associated therewith an alternative device with a GUI display (for example, a cell phone) that is used to provide summary status for an associated one of the badges using, for example, email, text messaging, an image on the cell phone, phone vibration, a sound, etc.

Server functionality for each of the badges may be provided by a single centralized server device that is continuously in communication with the badges or may be provided through other devices, including other badges. For example, each badge holder may carry an associated cell phone that is in communication with a remote/central validation server. As another example, only select badges in a particular zone may access a validation server (using one or more of the mechanisms discussed herein) while other badges in the same zone access server functionality by communicating with one of the select badges. Users within a zone having one of the select badges may request identity information from other users within the zone and may validate authorization of some or all of the other users. A validation server could display status of badges in a particular zone in a visual manner or using an audible manner. The status might be presented as a positive affirmation (for example a low beep may be emitted for each authorized user within presence of another authorized user and/or another user having one of the select badges). Thus, for example, a security guard wearing a select badge in the vicinity of a user wearing a visually plausible, yet invalid, badge could use the lack of a sound to detect the presence of the invalid badge. As another example, an authorized user may detect an unauthorized user in close proximity by the absence of a sound. Of course, other mechanisms, discussed herein, could also be used for this purpose.

If a badge of a user losses communication with all corresponding authorization server(s), a last access state and/or an out of communication indicator status may be displayed on the badge, or the badge may default to an invalid state. Any state information received from an authorization server may be valid for a specific period of time, or may have a duration that is considered valid.

The presence of any individual that is not authorized to be in a controlled zone could be logged by the system and appropriate alerts may be generated to security staff. Additionally, each badge holder may use their badge, or a device associated with their badge, to report a suspected unauthorized person within a zone along with a geographic location of the reporting badge holder and an estimate for a geographic position of the suspected unauthorized person.

BRIEF DESCRIPTION OF THE DRAWINGS

Embodiments of the system are described with reference to the several figures of the drawings, briefly described as follows.

DETAILED DESCRIPTION OF VARIOUS EMBODIMENTS

Figure 1:
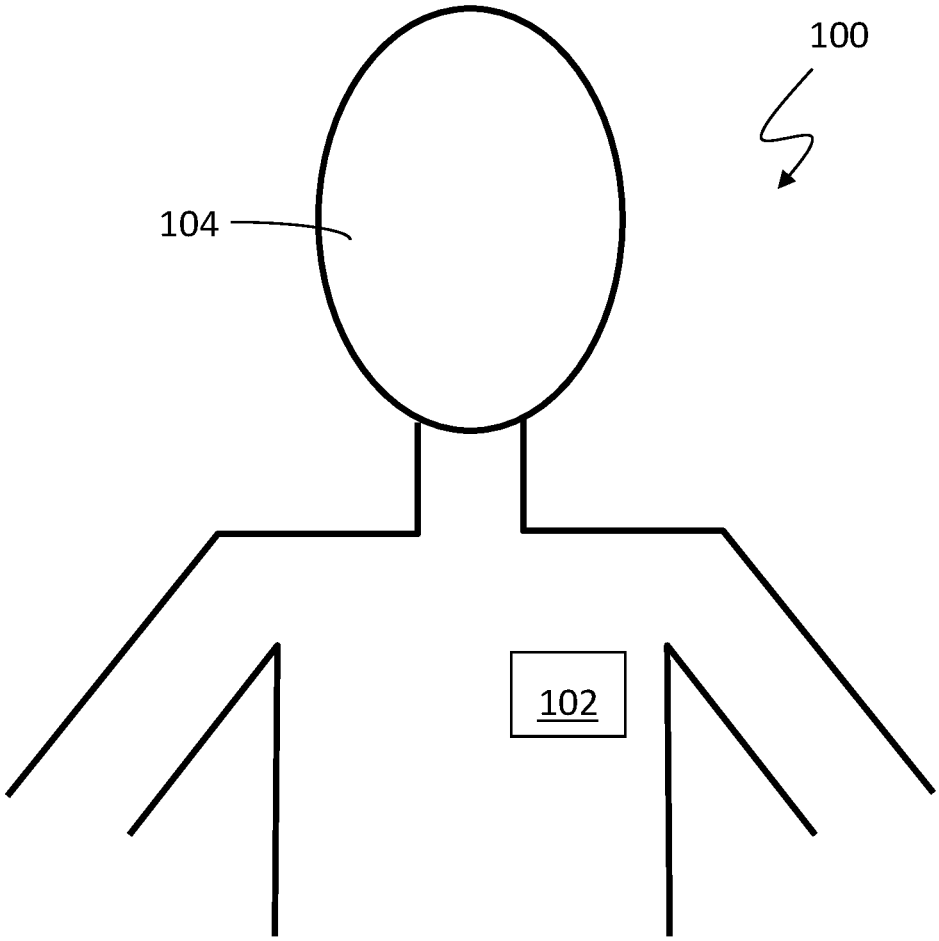
FIG. 1 is a diagram showing a user with an identity badge according to an embodiment of the system described herein.

Referring to FIG. 1, a user 100 is wearing an identity badge 102 that provides the user 100 with access to specific resources. For example, the identity badge 102 may allow the user to enter restricted areas in a company, such as restricted rooms in a bank, and/or allow the user 102 to access restricted computers or to log on to restricted company accounts. In some cases, the user 102 may present the identity badge 102 to a reader that is connected to a central database containing credentials of the user indicating resource(s) to which the user 100 has access as well as possibly allowable types/levels of access the user 100 may have to those resources. In other instances, the user 100 may present the identity badge 102 to a security guard (or similar) that may subsequently look up the user 100 in a database and/or present the identity badge 102 to a reader controlled by the security guard. The identity badge 102 may optionally include a visual image of the user 100 that may be designed to match a face 104 of the user 100, such as a photograph of the user. As discussed in more detail elsewhere herein, the identity badge 102 may also include one or more dynamic indicators that provide information about the authorization of the user 100 and/or other users (not shown) in a same zone as the user 100.

Figure 2A:
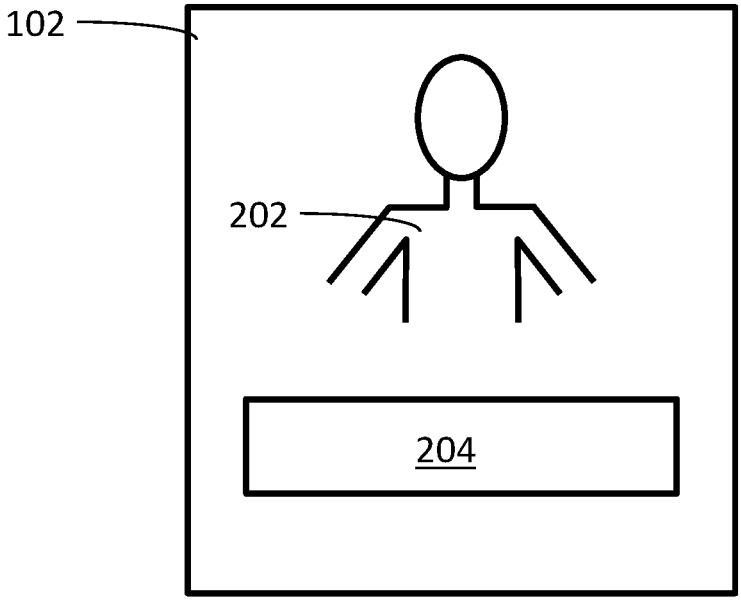
FIGS. 2A-2I are diagrams showing different configurations for indicating authorization status for an identity badge according to embodiments of the system described herein.

Referring to FIG. 2A, a first embodiment of the identity badge 102 is shown as including a visual image 202 of the user (photograph of the user) and additional information 204, such a name and authority level (e.g., secret, top secret, etc.) of the user. The visual image 202 is designed to match a face of the user. In some embodiments, the user joins an organization that issues the identity badge 102 and takes a photograph of the user and then causes the visual image 202 to be permanently affixed to the identity badge 102. In other embodiments, described elsewhere herein, the image 202 corresponding to a photograph of the user may be transmitted to the identity badge 102 (i.e., electronically) and may be modifiable while the user is wearing the identity badge 102.

The additional information 204 may be used to uniquely identify one or more of: the user, the identity badge 102, authentication status of the user, etc. In some embodiments, each badge holder may be issued a unique number (e.g., employee number) that may be encoded and displayed in an appropriate format (e.g., a bar code or a QR code) in the additional information 204 on the identity badge 102. In an embodiment herein, at least a portion of the additional information 204 may dynamically indicate an authorization level of the user at a current location (zone) of the user. For example, if the user is in a secure room, the additional information 204 may indicate "AUTHORIZED" or "UNAUTHORIZED", depending on whether the user is authorized to be in the room. As with the image 202, the AUTHORIZED/UNAUTHORIZED indication (or similar) may be transmitted to the identity badge 102 (i.e., electronically) and may be modifiable while the user is wearing the identity badge 102. Dynamically modifying the additional information 204 to indicate whether a user is authorized in a particular zone is described in more detail elsewhere herein. Note that the dynamic indication may last only a certain amount of time, which may or may not depend on a rate of refresh for dynamically modifying the identity badge 102. For example, if the identity badge 102 is refreshed once per minute, the indicator "AUTHORIZED" may automatically change to "UNAUTHORIZED" after, for instance, two minutes if a refresh signal is not received.

Figure 2B:
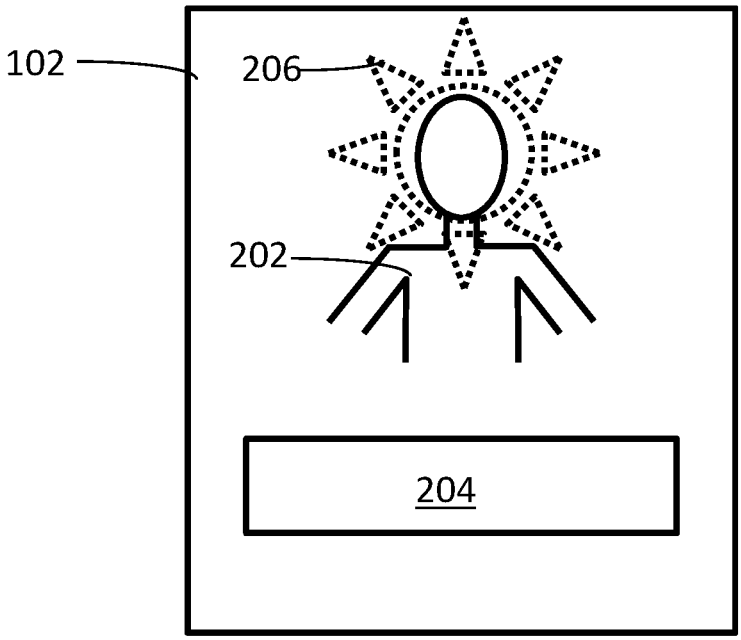

Referring to FIG. 2B, another embodiment of the identity badge 102 shows a watermark 206 superimposed on the image 202 of the user. In the embodiment of FIG. 2B, the additional information 204 may remain static (i.e., may be permanently affixed to the identity badge 102) while the watermark 206 is dynamically manipulated to selectively appear on the image 202. Appearance of the watermark 206 may be controlled by signals transmitted to the identity badge 102 (i.e., electronically) and may be modifiable while the user is wearing the identity badge 102. Note that the determination of whether the watermark 206 indicates authorization or lack of authorization is by convention, and may be selected by implementers of the system. Also note that, generally, "controlled" may be understood broadly to include "triggered" so that, for example, some processing may be performed at the identity badge 102 (e.g., which of a selection of different watermarks is to be displayed) which other processing (e.g., authorization to display a watermark) may be provided by the signals transmitted to the identity badge 102.

Figure 2C:
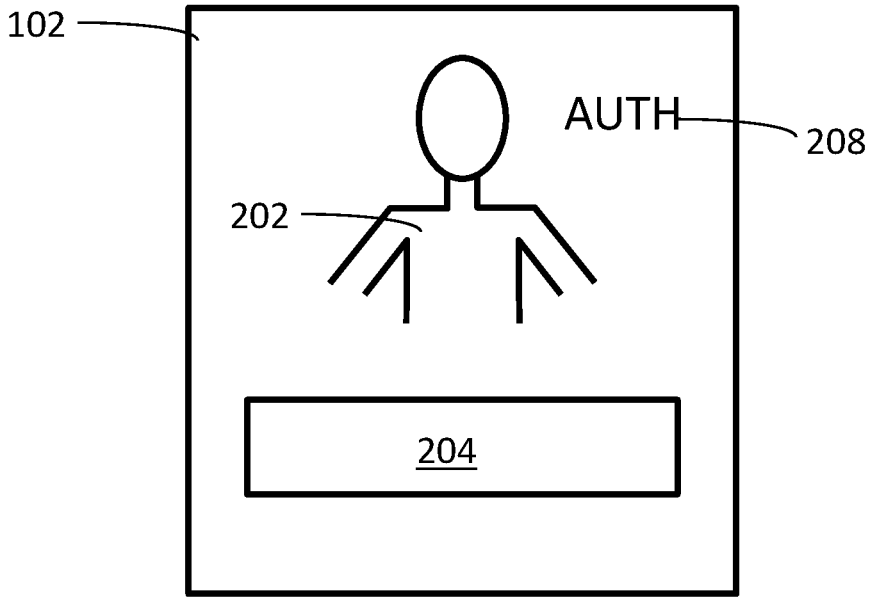

Referring to FIG. 2C, another embodiment of the identity badge 102 shows a separate indicator 208 provided on the identity badge 102. In the embodiment of FIG. 2C, the additional information 204 may remain static (i.e., may be permanently affixed to the identity badge 102) while the separate indicator 208 is dynamically manipulated to selectively appear on the badge 102. Appearance of the separate indicator 208 may be controlled by signals transmitted to the identity badge 102 (i.e., electronically) and may be modifiable while the user is wearing the identity badge 102. Note that the separate indicator 208 could be text (e.g., "AUTH" or "NO AUTH"), an icon, a symbol, or any other type of visual indicator that designates authority level of the user at a particular zone.

Figure 2D:
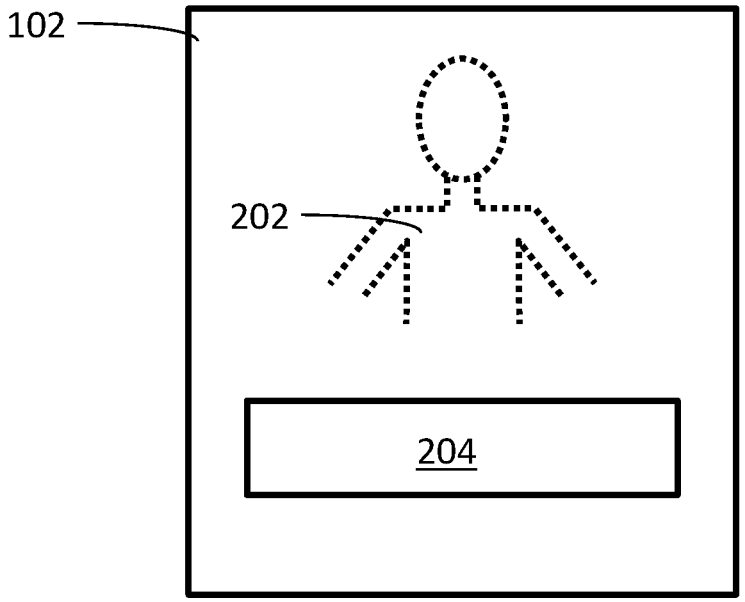

Referring to FIG. 2D, another embodiment of the identity badge 102 shows dimming the image 202 provided on the identity badge 102. In the embodiment of FIG. 2D, the additional information 204 may remain static (i.e., may be permanently affixed to the identity badge 102) while the image 202 is dynamically manipulated to have a different appearance (e.g., dimmed or not dimmed) on the badge 102. Appearance of the image 202 may be controlled by signals transmitted to the identity badge 102 (i.e., electronically) and may be modifiable while the user is wearing the identity badge 102. Note that, in some cases, the image 202 may be eliminated (i.e., may be dimmed so as to not appear). Note also that correlation of authorization level with how the image 202 is presented is by convention, and may be selected by implementers of the system. In an embodiment herein, appearance of the image 202 may indicate authorization in a zone and absence and/or dimming of the image 202 may indicate lack of authorization in the zone.

Figure 2E:
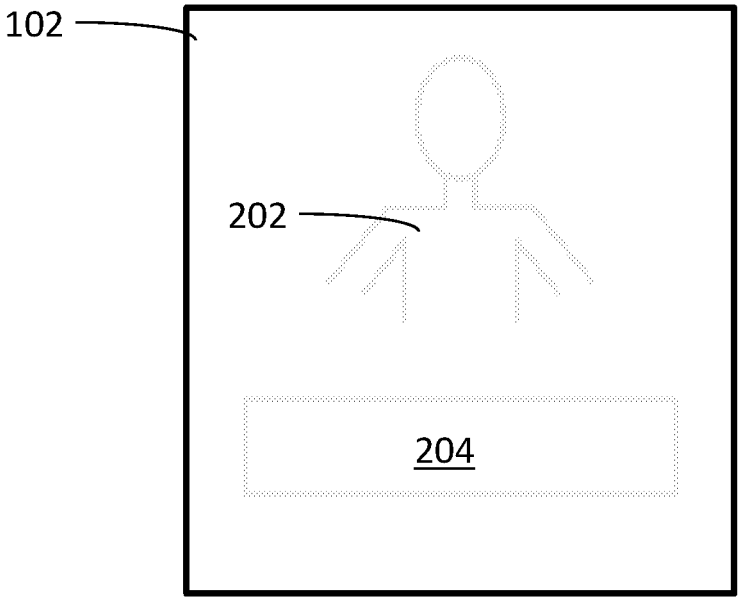

Referring to FIG. 2E, another embodiment of the identity badge 102 shows dimming the identity badge 102 (as opposed to just the image 202). In the embodiment of FIG. 2E, the additional information 204 may remain static (i.e., may be permanently affixed to the identity badge 102) while the identity badge 102 is dynamically manipulated to have a different appearance (e.g., dimmed or not dimmed). Appearance of the identity badge 102 may be controlled by signals transmitted to the identity badge 102 (i.e., electronically) and may be modifiable while the user is wearing the identity badge 102. Note that correlation of authorization level to how the identity badge 102 is presented is by convention, and may be selected by implementers of the system. In an embodiment herein, dimming the identity badge 102 may indicate lack of authorization in the zone.

Figure 2F:
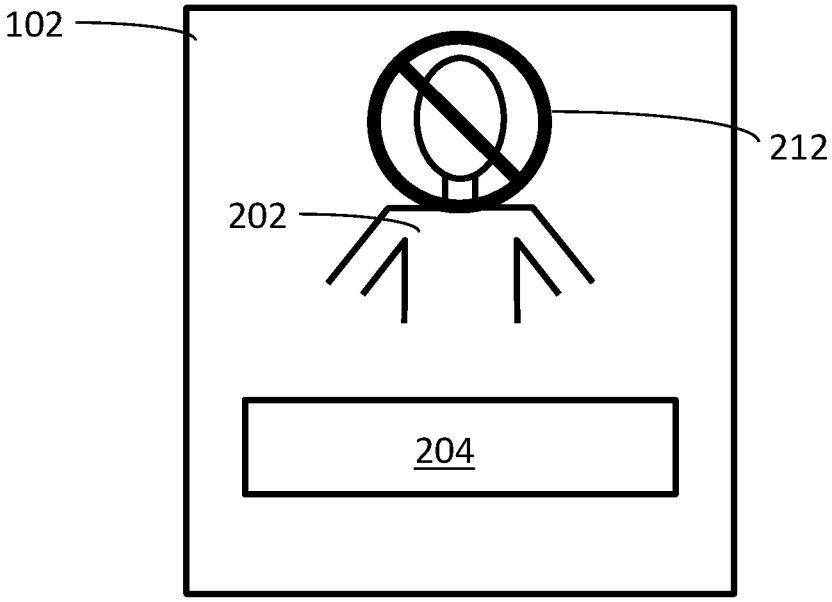

Referring to FIG. 2F, another embodiment of the identity badge 102 shows superimposing a strikethrough indicator 212 on to the image 202. In the embodiment of FIG. 2F, the additional information 204 may remain static (i.e., may be permanently affixed to the identity badge 102) while the identity badge 102 is dynamically manipulated to have a different appearance (e.g., adding the strikethrough indicator 212). Appearance of the identity badge 102 may be controlled by signals transmitted to the identity badge 102 (i.e., electronically) and may be modifiable while the user is wearing the identity badge 102. Note that correlation of authorization level to how the identity badge 102 is presented is by convention, and may be selected by implementers of the system. In an embodiment herein, adding the strikethrough indicator 212 may indicate lack of authorization in the zone.

Figure 2G:
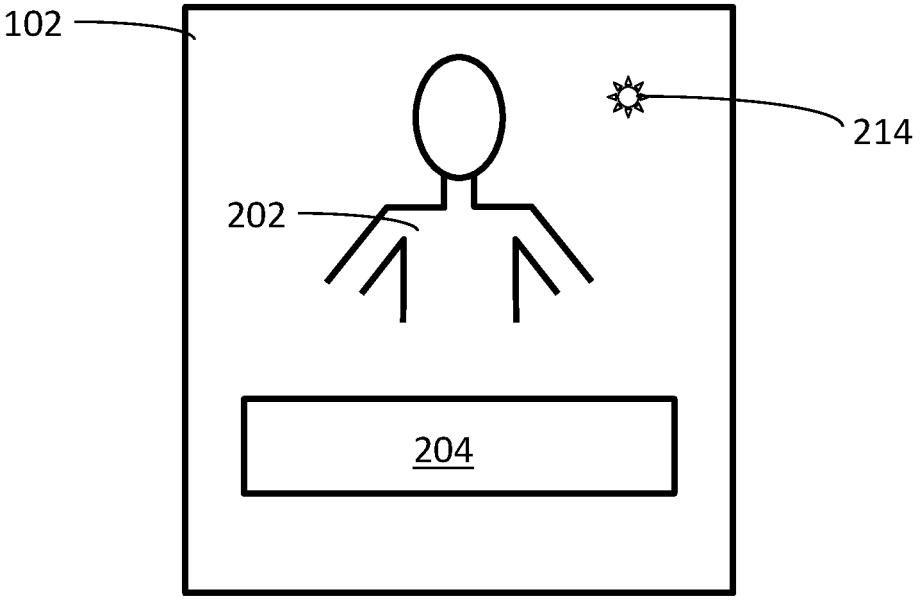

Referring to FIG. 2G, another embodiment of the identity badge 102 shows an LED 214 provided on the identity badge 102. In other embodiments, additional LEDs (not shown) may also be provided on the identity badge and may operate independently of each other. In the embodiment of FIG. 2G, the additional information 204 may remain static (i.e., may be permanently affixed to the identity badge 102) while the LED 214 is dynamically manipulated to alter the appearance thereof on the badge 102. For example, the LED 214 may be lit to a first color (e.g., green) to indicate authorization and to a second, different, color (e.g., red) to indicate lack of authorization. In other instances, the LED 214 may be lit to indicate authorization and unlit to indicate lack of authorization. Appearance of the LED 214 may be controlled by signals transmitted to the identity badge 102 (i.e., electronically) and may be modifiable while the user is wearing the identity badge 102.

Figure 2H:
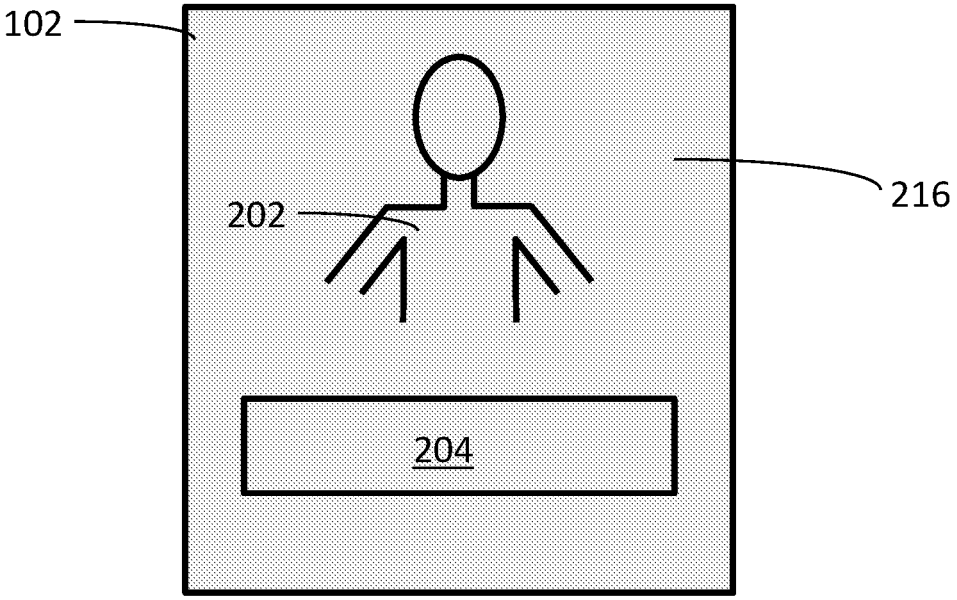

Referring to FIG. 2H, another embodiment of the identity badge 102 shows changing a background color 216 of the identity badge 102. In the embodiment of FIG. 2H, the additional information 204 may remain static (i.e., may be permanently affixed to the identity badge 102) while the identity badge 102 is dynamically manipulated to have a different appearance (e.g., different background color 216). Appearance of the identity badge 102 may be controlled by signals transmitted to the identity badge 102 (i.e., electronically) and may be modifiable while the user is wearing the identity badge 102. Note that correlation of authorization level to how the identity badge 102 is presented is by convention, and may be selected by implementers of the system so that, for example, a first background color indicates authorization while a second, different, background color indicates lack of authorization.

Figure 2I:
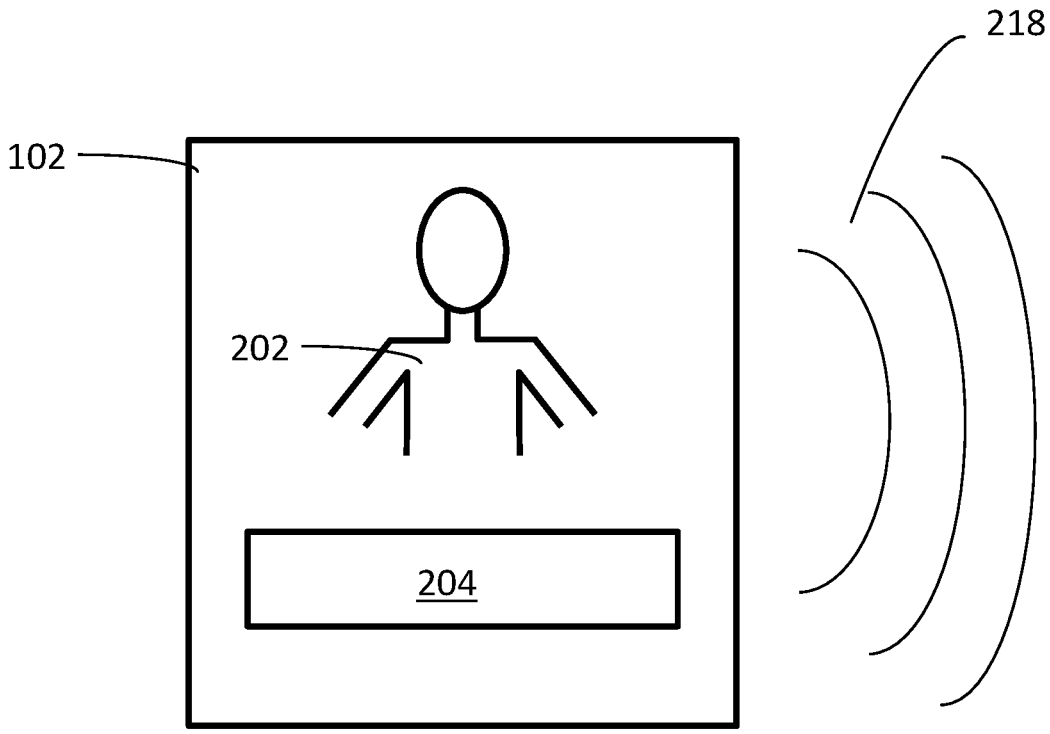

Referring to FIG. 2I, another embodiment of the identity badge 102 shows a sound 218 (or possibly a vibration) emanating from the identity badge 102. In the embodiment of FIG. 2I, appearance of the identity badge 102 may remain static (i.e., may be permanently affixed to the identity badge 102) while the sound 218 is dynamically manipulated. The sound 218 may be controlled by signals transmitted to the identity badge 102 (i.e., electronically) and may be modifiable while the user is wearing the identity badge 102. As with other embodiments, particular sounds/vibration patterns may be correlated to authorization level by convention, and may be selected by implementers of the system.

In some embodiments, some or all of the badges in a zone may indicate authorization status of some or all of the other badge holders in the zone. Thus, for example, in the embodiment of FIG. 2G, the LED may be off if the badge holder is not authorized, on and green if all of the badge holders in a zone are authorized, and on and red if the badge holder is authorized but other badge holders in the zone are not authorized.

Figure 3:
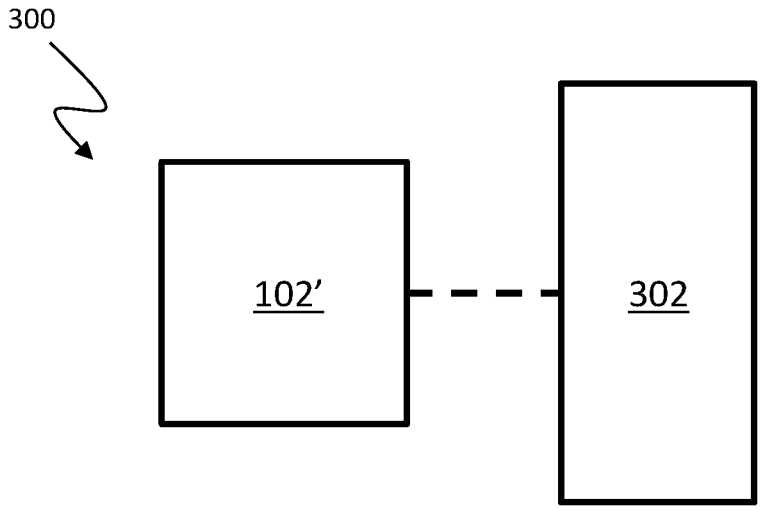
FIG. 3 is a diagram showing a badge in communication with a mobile device according to an embodiment of the system described herein.

Referring to FIG. 3, a diagram 300 illustrates an identity badge 102' in communication with a mobile device 302, such as a smartphone. Any appropriate type of communication may be used between the identity badge 102' and the mobile device 302, including, for example, WiFi, BlueTooth, etc. In some cases, a single user wears the identity badge 102' and possesses the mobile device 302. Some or all of the indication functionality discussed above in connection with FIGS. 2A-2I may be supplemented by the mobile device 302 or, in some cases, provided exclusively by the mobile device 302 instead of the identity badge 102'. In addition, as discussed in more detail elsewhere herein, the mobile device 302 may also assist in connection with communication between the identity badge 102' and an authorization server (not shown in FIG. 3).

Figure 4:
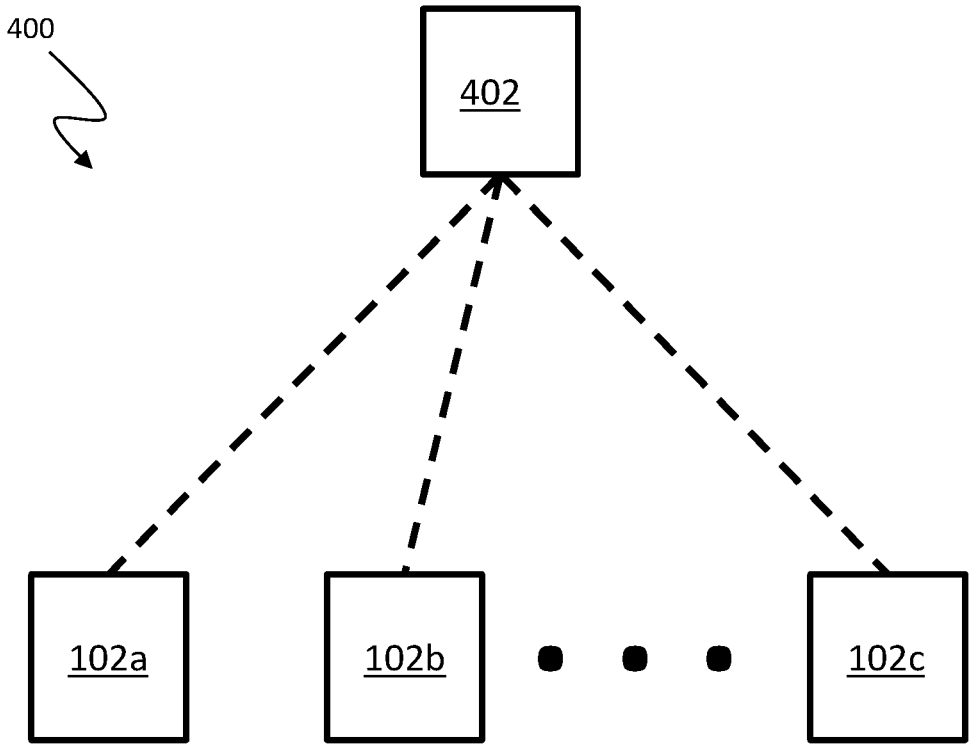
FIG. 4 is a diagram showing a plurality of badges and a server according to an embodiment of the system described herein.

Referring to FIG. 4, a diagram 400 shows a plurality of identity badges 102*a*-102*c* in communication with an authorization server 402. Communication between the badges 102*a*-102*c* and the server 402 may be by any appropriate mechanism, such as BlueTooth, WiFi, etc. and/or possibly a combination of mechanisms, such as a combination of a WiFi connection to the badges 102*a*-102*c* and a wired connection from a wireless access point to the server 402. The server 402 may be local to the badges 102*a*-102*c*, or may be remote to at least some of the badges 102*a*-102*c*. The badges 102*a*-102*c* represent any number of badges and it is possible for different ones of the badges 102*a*-102*c* to be provided in different locations. In some cases, it is possible for some of the badges 102*a*-102*c* to be in communication with a local mobile device, as illustrated in the diagram 300 and described above, and for the local mobile device to handle communication with the server 402.

As described in more detail elsewhere herein, the server receives location information from the badges 102*a*-102*c* as well as signals from badge readers (not shown) and information regarding permissible authorizations of different users and, based on received data, provides signals to the badges 102*a*-102*c* to cause each of the badges 102*a*-102*c* to provide an authorization indication as described elsewhere herein. For example, a badge holder having the badge 102*a* may enter a particular zone that is off limits to the badge holder. In such a case, the server 402 may receive a signal from the badge indicating that the badge is in the particular zone and, in response thereto, send a signal to the badge 102*a* to indicate that the badge holder is not authorized to be in the particular zone. As discussed elsewhere herein, this indication can take any of a variety of forms, such as dimming information displayed on the badge 102*a*. Operation of the server 402 is described in more detail elsewhere herein.

Figure 5:
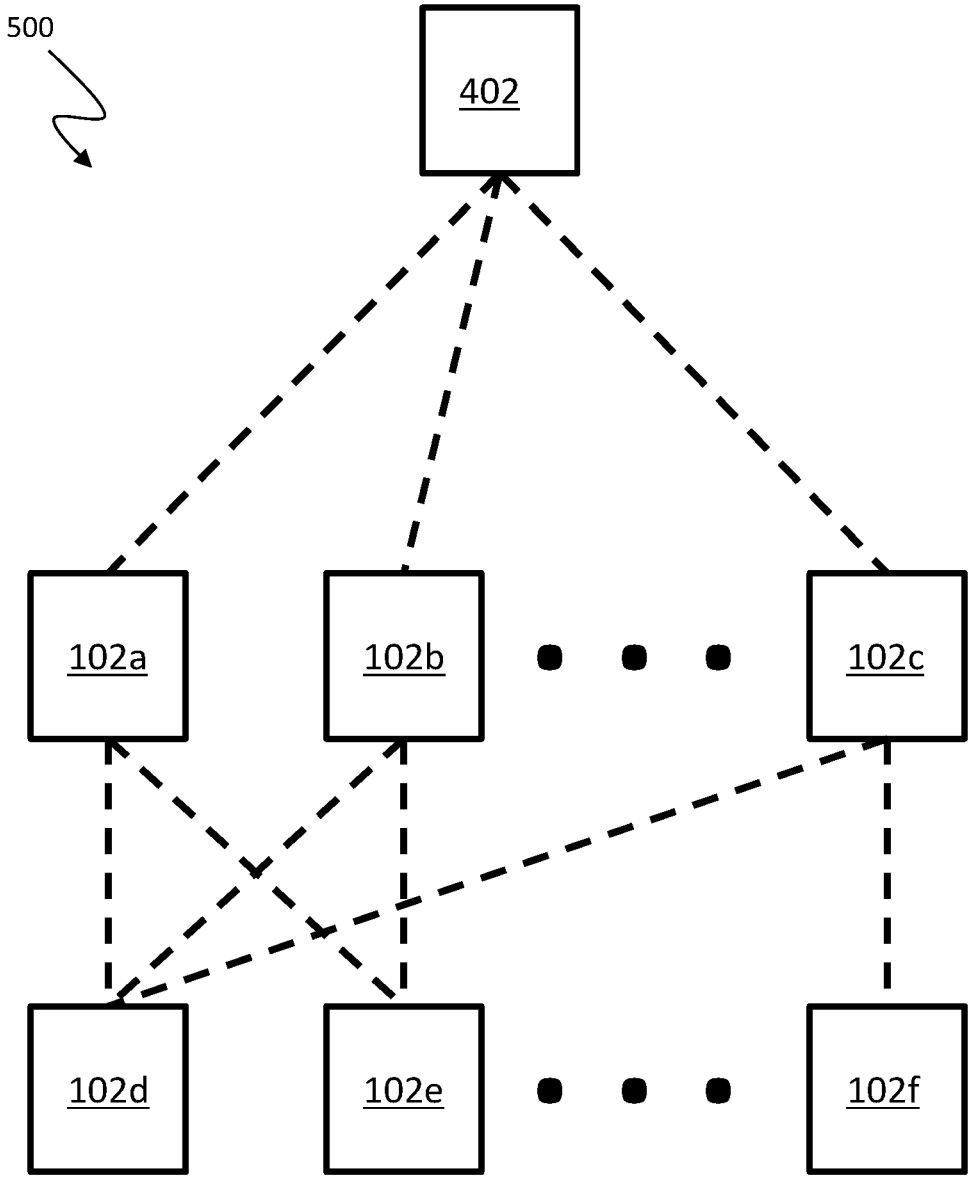
FIG. 5 is a diagram showing a plurality of badges and a server with some badges communicating through other badges according to an embodiment of the system described herein.

Referring to FIG. 5, a diagram 500 illustrates an embodiment where a plurality of badges 102*d*-102*f* do not communicate directly with the server 402 but, instead, communicate indirectly with the server 402 through one or more of the other badges 102*a*-102*c* that do communicate directly with the server 402. Thus, for example, the badge 102*d* may communicate indirectly with the server 402 through the badge 102*a*, that does communicate directly with the server 402. In some cases, a badge may communicate through any other badge that communicates with the server 402. This is illustrated by connections from the badge 102*d* to each of the badges 102*a*-102*c*. In other instances, a badge may communicate through only a subset of other badges that communicates with the server 402. This is illustrated by the badge 102*e*, which is connected to the badges 102*a*, 102*b* but not to the badge 102*c*. In still other instances, a badge may communicate through only one other badge that communicates with the server 402. This is illustrated by the badge 102*f*, which is connected to the badge 102*c*, but not to any other badges. In some embodiments, one or more of the badges 102*a*-102*c* may cache authorization information and provide at least some of the functionality of the server 402. Note also that, in some cases, the server 402 may be a badge itself and/or a mobile device associated with (in communication with) one or more badges.

Figure 6:
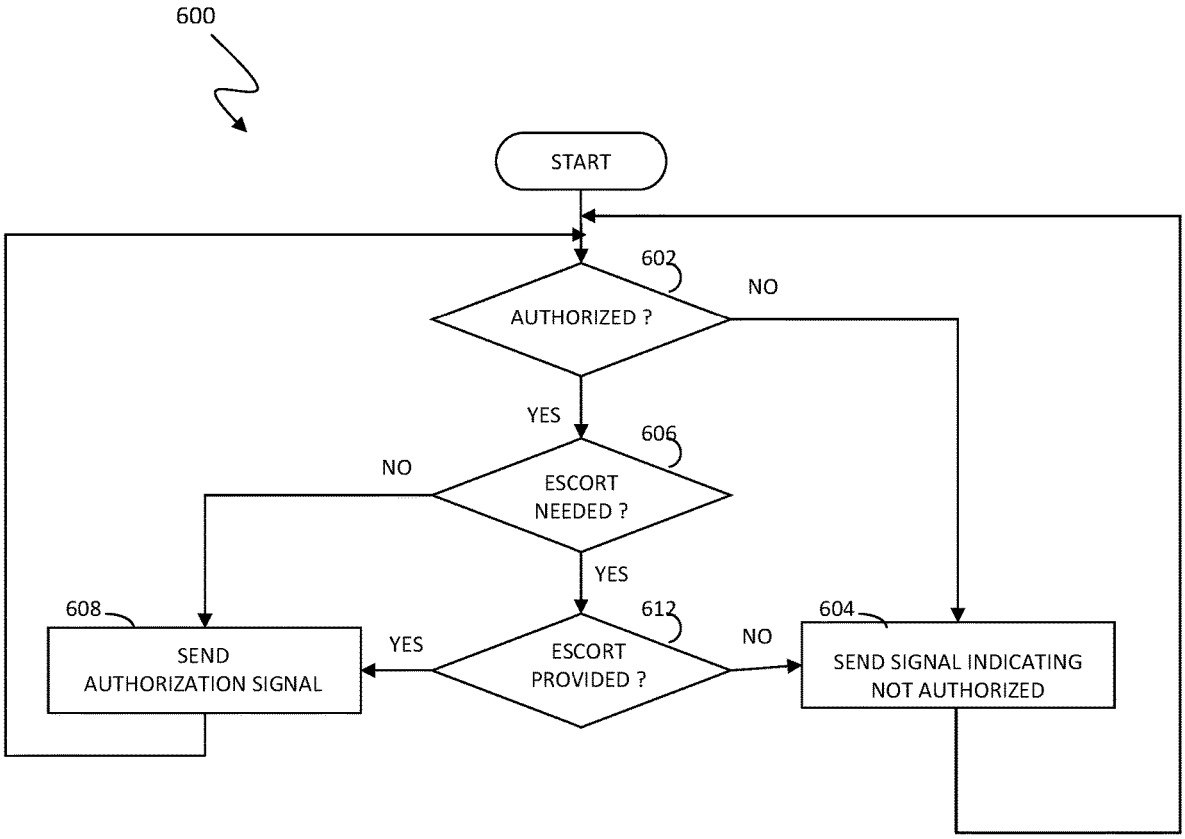
FIG. 6 is a flow diagram illustrating determining authorization of a badge holder according to an embodiment of the system described herein.

Referring to FIG. 6, a flow diagram 600 illustrates processing performed at the server 402 in connection with providing signals to the badges 102*a*-102*f* to indicate whether a badge holder is authorized to be in a particular zone. In an embodiment herein, each of the badges 102*a*-102*f* queries the server 402 periodically (e.g., once per minute). Processing illustrated by the flow diagram is performed by the server 402 at each iteration. Note that the signals provided by the server 402 to the badges 102*a*-102*f* are independent of any readers accessing the badges 102*a*-102*f* since the badges 102*a*-102*f* may remain in a particular controlled zone and thus may not be accessed by any readers, which often are used in connection with initial entry and exit in to and out of controlled zones.

Processing begins at a test step 602 where it is determined if the badge holder is authorized to be in a zone where the badge is located. Note that, as discussed elsewhere herein, it is possible for a badge holder to be initially authorized for a controlled zone and then to become unauthorized for the controlled zone for any number of reasons, including a mistake in the initial authorization, a change in status/access rights, entry of others with higher authorization level, etc. Change in authorization may occur while the badge holder remains in the controlled zone (i.e., may be independent of the badge holder entering or leaving the controlled zone). Querying the server 402 iteratively allows for proper handling of any authorization changes that occur while a user remains in a single zone. If it is determined at the step 602 that the badge holder is not authorized, control transfers from the step 602 to a step 604 where signals are provided to the badge to indicate that the badge holder is not authorized. Following the step 604, processing returns back to the step 602, discussed above, for another iteration.

If it is determined at the step 602 that the badge holder is authorized, then control transfers from the step 602 to a test step 606 where it is determined if the badge holder requires an escort in a particular zone. As discussed elsewhere herein, in some cases, a badge holder may be required to have an authorized escort present while the badge holder is in a particular zone. Also, as discussed elsewhere herein, a badge holder may be required to maintain an additional device, such as a mobile phone, and thus "escort" could be understood to include a required device instead of (or in addition to) a required person. If it is determined at the test step 606 that an escort is not needed, then control transfers from the test step 606 to a step 608 where signals indicating that the badge holder is authorized to be in the zone are provided to the badge. Following the step 608, processing returns back to the step 602, discussed above, for another iteration.

If it is determined at the test step 606 that an escort is required, then control transfers from the test step 606 to a test step 612 where it is determined if the required escort has been provided. In the case of the escort being another person, the test at the step 612 determined if a badge of the other person is detected in the zone. If the "escort" is another device, the test at the step detects the other device. Note that, generally, an "escort" could include more than one person, more than one device, or some combination of people and devices. If it is determined at the step 612 that an escort has been provided, then control transfers from the step 612 to the step 608, discussed above, where signals indicating that the badge holder is authorized to be in the zone are provided to the badge. Following the step 608, processing returns back to the step 602, discussed above, for another iteration. If it is determined at the step 612 that an escort has not been provided, then control transfers from the step 612 to the step 604, discussed above, where signals are provided to the badge to indicate that the badge holder is not authorized. Following the step 604, processing returns back to the step 602, discussed above, for another iteration.

Various embodiments discussed herein may be combined with each other in appropriate combinations in connection with the system described herein. Additionally, in some instances, the order of steps in the flow charts, flow diagrams and/or described flow processing may be modified, where appropriate. Further, various aspects of the system described herein may be implemented using software, hardware, a combination of software and hardware and/or other computer-implemented modules or devices having the described features and performing the described functions. The system may further include a display and/or other computer components for providing a suitable interface with other computers and/or with a user. Software implementations of the system described herein may include executable code that is stored in a computer-readable medium and executed by one or more processors. The computer-readable medium may include volatile memory and/or non-volatile memory, and may include, for example, a computer hard drive, ROM, RAM, flash memory, portable computer storage media such as a CD-ROM, a DVD-ROM, a flash drive or other drive with, for example, a universal serial bus (USB) interface, and/or any other appropriate tangible or non-transitory computer-readable medium or computer memory on which executable code may be stored and executed by a processor. The system described herein may be used in connection with any appropriate operating system.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A security system, comprising:

a first security badge having a visual portion that varies according to signals provided to the first security badge; and an authorization server that provides the signals to the first security badge in response to periodic queries of the authorization server by the first security badge while the first security badge remains in a controlled zone;

wherein the controlled zone is defined by one or more badge readers controlling initial access to the controlled zone; and wherein the periodic queries by the first security badge and the corresponding responsive signals from the authorization server are independent of any of the one or more badge readers accessing the first security badge.

2. A security system, according to claim 1, wherein the first security badge is read by any of the one or more badge readers only in connection with initial entry into the controlled zone.

3. A security system, according to claim 1, wherein authorization of a user of the first security badge varies while the user remains in the controlled zone.

4. A security system, according to claim 1, wherein the first security badge includes a visual image of the user of the first security badge and displays additional information.

5. A security system, according to claim 4, wherein the additional information includes name and authorization status of the user.

6. A security system, according to claim 5, wherein the authorization status of the user is indicated by at least one of: a watermark superimposed on the image of the user, a word or phrase dynamically provided on the first security badge, dimming the image of the user, dimming the first security badge, a strikethrough superimposed on the image of the user, an LED provided on the first security badge, or a background color of the first security badge.

7. A security system, according to claim 5, wherein the authorization status of the user is indicated by a sound provided by the first security badge.

8. A security system, according to claim 1, wherein the first security badge queries the authorization server using a smartphone that is in communication with the first security badge and with the authorization server.

9. A security system, according to claim 1, wherein the queries from the first security badge to the authorization server include location information indicating a location of the first security badge.

10. A security system, according to claim 9, wherein the authorization server uses the location information to determine authorization for the first security badge.

11. A security system, according to claim 1, further comprising:

a second security badge provided in the controlled zone.

12. A security system, according to claim 11, wherein the first security badge indicates authorization status of the second security badge.

13. A security system, according to claim 11, wherein the second security badge queries the first security badge for authorization status of the second security badge.

14. A method of operating a security system, comprising:

providing a first security badge having a visual portion that varies according to signals provided to the first security badge;

the first security badge periodically querying an authorization server while the first security badge remains in a controlled zone, wherein the controlled zone is defined by one or more badge readers controlling initial access to the controlled zone; and the authorization server providing the signals to the first security badge responsive to the periodic queries;

wherein the periodic queries by the first security badge and the corresponding responsive signals from the authorization server are independent of any of the one or more badge readers accessing the first security badge.

15. A method, according to claim 14, wherein the first security badge is read by any of the one or more badge readers only in connection with initial entry into the controlled zone.

16. A method, according to claim 14, wherein authorization of a user of the first security badge varies while the user remains in the controlled zone.

17. A method, according to claim 14, wherein the first security badge includes a visual image of the user of the first security badge and displays additional information.

18. A method, according to claim 17, wherein the additional information includes name and authorization status of the user.

19. A method, according to claim 18, wherein the authorization status of the user is indicated by at least one of: a watermark superimposed on the image of the user, a word or phrase dynamically provided on the first security badge, dimming the image of the user, dimming the first security badge, a strikethrough superimposed on the image of the user, an LED provided on the first security badge, or a background color of the first security badge.

20. A non-transitory computer readable medium containing software that operates a security system, the software comprising executable code that implements the method of:

varying a visual portion of a first security badge according to signals provided to the first security badge;

periodically querying an authorization server by the first security badge while the first security badge remains in a controlled zone, wherein the controlled zone is defined by one or more badge readers controlling initial access to the controlled zone; and providing the signals to the first security badge from the authorization server responsive to the periodic queries;

wherein the periodic queries by the first security badge and the corresponding responsive signals from the authorization server are independent of any of the one or more badge readers accessing the first security badge.

* * * * *